US012601021B2

(12) United States Patent
Zhou et al.

(10) Patent No.: US 12,601,021 B2
(45) Date of Patent: Apr. 14, 2026

(54) COUPLING SYSTEM OF COPPER SLAG RECYCLING AND $CO_2$ MINERALIZATION BASED ON INDUSTRIAL SOLID WASTE

(71) Applicant: Greenore Holding Co., Wilmington, DE (US)

(72) Inventors: Xiaozhou Zhou, Shanghai (CN); Yunfeng Zhang, Shanghai (CN); Rui Cui, Shanghai (CN)

(73) Assignee: GREENORE HOLDING CO., Wilmington, DE (US)

( * ) Notice: Subject to any disclaimer, the term of this patent is extended or adjusted under 35 U.S.C. 154(b) by 763 days.

(21) Appl. No.: 17/941,379

(22) Filed: Sep. 9, 2022

(65) Prior Publication Data

US 2023/0323490 A1 Oct. 12, 2023

(30) Foreign Application Priority Data

Apr. 8, 2022 (CN) ..... 202210367824.7

(51) Int. Cl.
*C21B 13/00* (2006.01)

(52) U.S. Cl.
CPC ..... *C21B 13/0073* (2013.01); *C21B 2400/03* (2018.08)

(58) Field of Classification Search
CPC ..... C21B 13/0073; C21B 2400/03; C21B 2100/26; C21B 13/00; C22B 7/001; C22B 7/04; C22B 15/0054; C22B 1/005; C01F 5/24; C01F 11/18; Y02P 10/20
USPC ..... 75/433
See application file for complete search history.

(56) References Cited

FOREIGN PATENT DOCUMENTS

| | | | | |
|---|---|---|---|---|
| CN | 107460322 | A | 12/2017 | |
| CN | 207738771 | U | 8/2018 | |
| CN | 111558606 | A | 8/2020 | |
| JP | 2011149055 | A | 8/2011 | |
| JP | 2016160110 | A | 9/2016 | |
| WO | WO-2011047070 | A1 * | 4/2011 | ..... C01F 11/18 |

(Continued)

OTHER PUBLICATIONS

WO2019071788A1 Translation (Year: 2019).*

*Primary Examiner* — Danielle M. Carda
(74) *Attorney, Agent, or Firm* — Bayramoglu Law Offices LLC

(57) ABSTRACT

A coupling system of copper slag recycling and $CO_2$ mineralization process based on industrial solid waste includes the following steps: obtaining copper slags, performing a slag forming treatment, obtaining reforming slags, obtaining sponge iron, coupling the reforming slag with a $CO_2$ mineralization process based on industrial solid waste, and coupling the $CO_2$ generated in the process of obtaining sponge iron with the $CO_2$ mineralization process based on industrial solid waste. The system includes a slag forming treatment device, a secondary treatment device, a first coupling device, and a second coupling device. The coupling system couples the recycling of copper slag with the existing $CO_2$ mineralization process based on industrial solid waste. Various production lines can be organically integrated in a green and clean manner for both reforming slag and flue gas.

12 Claims, 3 Drawing Sheets

(56) References Cited

FOREIGN PATENT DOCUMENTS

| | | | | |
|---|---|---|---|---|
| WO | WO-2019071788 A1 * | 4/2019 | ..... | C22B 7/004 |
| WO | 2019242607 A1 | 12/2019 | | |

* cited by examiner

COUPLING SYSTEM OF COPPER SLAG RECYCLING AND $CO_2$ MINERALIZATION BASED ON INDUSTRIAL SOLID WASTE

CROSS REFERENCE TO THE RELATED APPLICATIONS

This application is based upon and claims priority to Chinese Patent Application No. 202210367824.7, filed on Apr. 8, 2022, the entire contents of which are incorporated herein by reference.

TECHNICAL FIELD

The application belongs to the field of hydrometallurgy technology, carbon capture, utilization and storage (CCUS), and resource utilization of solid waste, specifically relating to the coupling system of copper slag recycling and $CO_2$ mineralization based on industrial solid waste.

BACKGROUND

Copper metallurgy is an important industry in the field of non-ferrous metals in China. The development of copper metallurgy has focused on clean copper metallurgy methods, comprehensive recovery of valuable metals and effective utilization of resources. Copper slag, produced in the process of copper smelting, is a kind of non-ferrous metal slags. The waste slag discharged from copper smelting by reverberatory furnace method is copper slag of reverberatory furnace, and the slag discharged from copper smelting by blast furnace is copper slag of blast furnace. For each ton of copper produced, the reverberatory furnace method will produce 10-20 tons of slag and the blast furnace method will produce 50-100 tons of copper slag. The main mineral in the slag is iron-bearing mineral, and the grade of iron generally exceeds 40%, which is much higher than 29.1%, the average industrial grade of iron ore. It has been a focus of relevant technicians to discover techniques to efficiently recycle these copper slags. Rotary hearth furnace process is a direct reduction process evolved from the process of steel rolling annular heating furnace in the recent 40 years. It has the advantages of fast reaction kinetics and a wide adaptability to raw materials. There is also a relatively novel oxygen-enriched bottom blowing bath smelting process, which has the advantage of cleanness and high efficiency.

Although the above processes have their own advantages, they haven't been widely applied because of their obvious shortcomings. The flue gas treatment of rotary hearth furnace technology is a thorny problem. Due to the low melting point of zinc, lead, potassium and other substances, the characteristics of flue gas from rotary hearth furnace are quite different from conventional metallurgical flue gas, making the flue gas difficult to treat and recycle. Two rotary hearth furnaces in China have been retrofitted on their flue gas systems only less than a year after operation. In addition, the composition of feedstock of rotary hearth furnace is complex. If the furnace is frequently started and shut down, corrosion will also accelerate, restraining a continuous production. It's reported that two cases of furnace roof collapse occurred in a rotary hearth furnace in less than one year of operation. Compared with the rotary hearth furnace process, the oxygen-enriched bottom-blowing bath smelting process is relatively novel. However, such novel method is faced with the issues of insufficient fundamental research and a low level of automation, and therefore a long way is still needed for this method to be fully applied in practical productions.

SUMMARY

In view of the shortcomings or deficiencies of the above existing technologies, this invention is to provide a coupling system of copper slag recycling and $CO_2$ mineralization process based on industrial solid waste.

In order to solve the above technical problems, this invention is realized through the following technical schemes.

This invention proposes a coupling system of copper slag recycling and $CO_2$ mineralization based on industrial solid waste, including the following steps:

- obtaining copper slags;
- performing a slag forming treatment based on the copper slag;
- obtaining reforming slags based on the slag forming treatment;
- obtaining sponge iron based on the reforming slag;
- coupling the reforming slag with a $CO_2$ mineralization process based on industrial solid waste;
- coupling the $CO_2$ generated in the process of obtaining sponge iron with the $CO_2$ mineralization process based on industrial solid waste.

Furthermore, the $CO_2$ generated in the slag forming treatment process is coupled with the $CO_2$ mineralization process based on industrial solid waste.

Furthermore, the carbonate products obtained by the $CO_2$ mineralization process based on industrial solid waste will partially participate in the above slag forming treatment.

Furthermore, the method for obtaining sponge iron based on the reforming slag also includes a step of inputting syngas or CO or $H_2$ or a mixture of CO and $H_2$.

Furthermore, before coupling the obtained reforming slag with the $CO_2$ mineralization process based on industrial solid waste, desulfurization treatment is applied to the reforming slag.

Furthermore, the $CO_2$ mineralization process based on industrial solid waste includes the following steps:

- a mixing reaction process based on industrial solid waste, auxiliary reagent, and $CO_2$;
- a solid-liquid separation treatment based on the slurry produced in the above mixing reaction process;
- the obtainment of the supernatant and unreacted solid particles.

Furthermore, a carbonate product is prepared based on the supernatant obtained above; And/or, the unreacted solid particles are recycled to the mixing reaction process.

Furthermore, the carbonate product includes calcium carbonate, magnesium carbonate or calcium magnesium carbonate.

In addition, the invention proposes the coupling system of copper slag recycling and $CO_2$ mineralization process based on industrial solid waste, including:

- a slag forming treatment device, which is used to obtain reforming slag from the copper slag;
- a secondary treatment device, which is employed for secondary treatment of the reforming slag to obtain sponge iron;
- a first coupling device, which is designed to convey the obtained reforming slag to the $CO_2$ mineralization device based on industrial solid waste;

a second coupling device, which is configured to transport the $CO_2$ generated by the secondary treatment device to the $CO_2$ mineralization device based on industrial solid waste.

Furthermore, the first coupling device also transports the $CO_2$ generated in the slag forming treatment device to the $CO_2$ mineralization device based on industrial solid waste.

Furthermore, the system also includes a third coupling device, which is used to transport part of the carbonate products generated by the $CO_2$ mineralization device based on industrial solid waste to the slag forming treatment device.

Furthermore, the system also includes a desulfurization device, which is used to desulfurize the reforming slag before it moves into to the $CO_2$ mineralization device based on industrial solid waste.

Furthermore, the $CO_2$ mineralization device based on industrial solid waste includes:

a mixing reaction device, where the industrial solid waste, auxiliary reagent and $CO_2$ are reacted in the mixing reaction device;

a solid-liquid separation device, where the slurry generated by the above mixing reaction is subjected to a solid-liquid separation.

Furthermore, the system also includes a product preparation device for producing carbonate products based on the clear liquid phase after the solid-liquid separation device.

Compared with the prior art, the application has the following technical effects.

The invention realizes the separation and desulfurization of raw materials through slag forming and other treatments of copper slag, which not only ensures the purity and quality of products, but also enables a green and efficient production. Moreover, the invention can couple the recycling of copper slag with the existing $CO_2$ mineralization process based on industrial solid waste. Various production lines can be organically integrated in a green and clean manner for both reforming slag and flue gas. At the same time, the selection range and acquisition mode of $CO_2$ source are expanded for $CO_2$ mineralization process based on industrial solid waste, and the engineering cost of $CO_2$ mineralization process based on industrial solid waste is reduced.

The carbonate products produced from the $CO_2$ mineralization process based on industrial solid waste can be partially recycled to the slag forming treatment process, as slag forming agent or a supplement to the slag forming agent that needs to be added. In this way, another internal circulation system is constructed. Compared with the prior art, the circulation process is advantageous in that the calcium and magnesium elements in the existing industrial solid waste can be fully utilized, and the resources can be well reused. The internal circulation process can also ensure the continuity of the reaction process and improve the reaction efficiency.

BRIEF DESCRIPTION OF THE DRAWINGS

To explicitly illustrate the characteristics, purposes, and advantages of this invention, a brief description of the drawings is presented.

DETAILED DESCRIPTION OF THE EMBODIMENTS

The technical scheme in the embodiment of the invention will be described clearly and comprehensively in combination with the attached drawings in the embodiment of the invention. Obviously, the described embodiments are only part of all the embodiments of the invention. Based on the embodiments in the invention, all other embodiments obtained by technicians belong to the scope of protection of this application, unless other creative breakthrough can distinguish its work significantly and fundamentally different from this technology.

Figure 1:
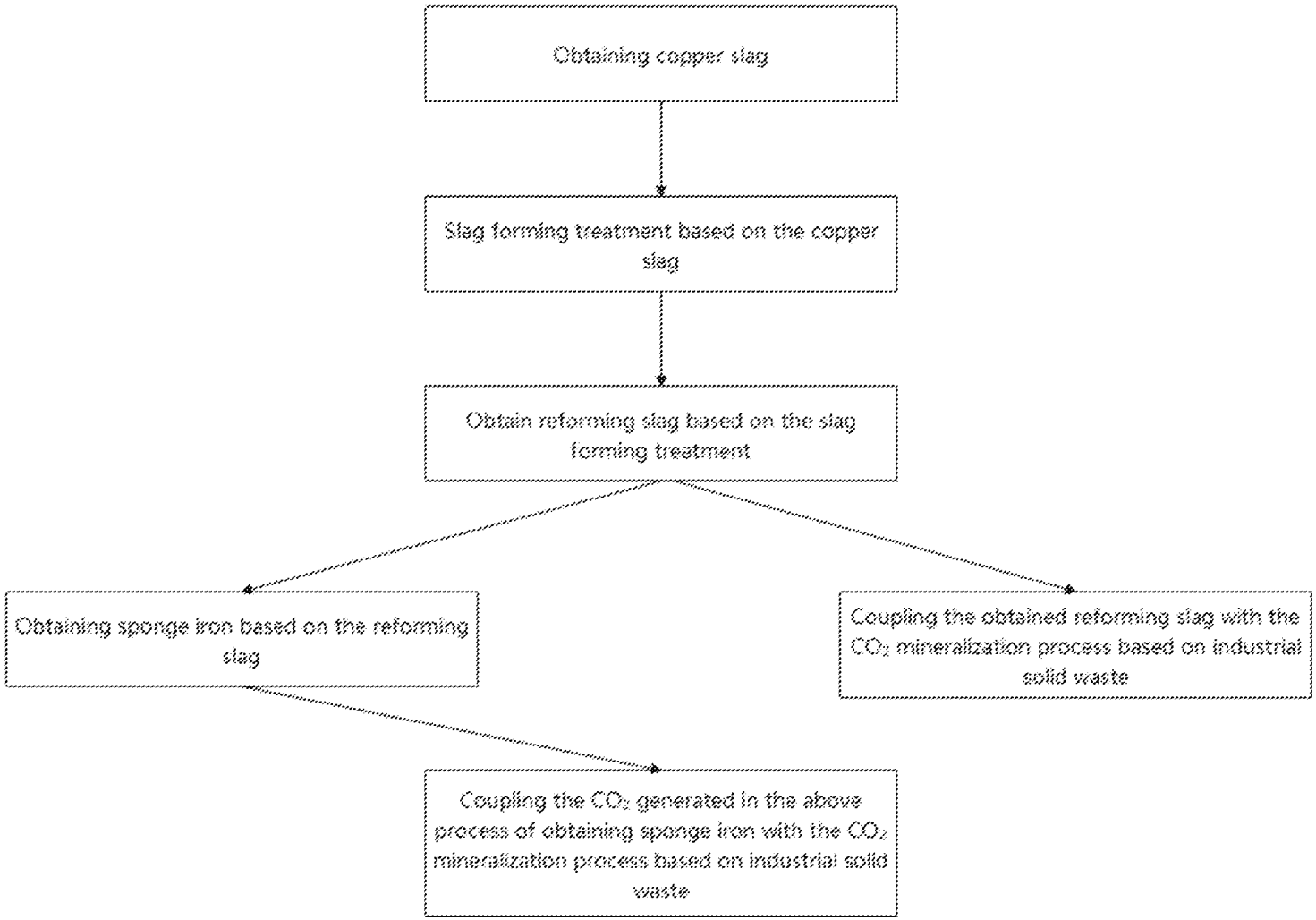
FIG. 1: block diagram of the coupling system of copper slag recycling and $CO_2$ mineralization process based on industrial solid waste in an embodiment of the invention.

As shown in FIG. 1, in one embodiment of the invention, the coupling system of copper slag recycling and $CO_2$ mineralization process based on industrial solid waste includes the following steps:

Step 1, obtaining copper slags;

Step 2, performing a slag forming treatment based on the copper slag;

Step 3, obtaining reforming slags based on the slag forming treatment;

Step 4, obtaining sponge iron based on the reforming slag;

Step 5, coupling the reforming slag with the $CO_2$ mineralization process based on industrial solid waste;

Step 6, coupling the $CO_2$ generated in the process of obtaining sponge iron with the $CO_2$ mineralization process based on industrial solid waste.

In this embodiment, the separation and desulfurization of raw materials are realized through slag forming and other treatments of copper slag, which not only ensures the purity and quality of products, but also enables a green and efficient production. Moreover, the invention can couple the recycling of copper slag with the existing $CO_2$ mineralization process based on industrial solid waste. Various production lines can be organically integrated in a green and clean manner for both reforming slag and flue gas. At the same time, the selection range and acquisition mode of $CO_2$ source are expanded for $CO_2$ mineralization process based on industrial solid waste, and the engineering cost of $CO_2$ mineralization process based on industrial solid waste is reduced.

The above reaction steps, as one of the examples, can be carried out continuously or simultaneously in the actual production process.

In this embodiment, the slag forming treatment based on copper slag includes but is not limited to treatments such as melting.

In order to further realize the internal circulation and reuse of resources, the $CO_2$ generated in the slag forming treatment process is preferably coupled with the $CO_2$ mineralization process based on industrial solid waste. In this embodiment, in addition to the $CO_2$ produced in the process of obtaining sponge iron as one of the $CO_2$ sources in the $CO_2$ mineralization process based on industrial solid waste, the $CO_2$ produced in the slag forming process can also be used as another way to obtain $CO_2$ in the $CO_2$ mineralization process based on industrial solid waste.

Furthermore, in the specific implementation process, the $CO_2$ source of the $CO_2$ mineralization process based on industrial solid waste can also come from power plant flue gas, blast furnace, converter, refining furnace, lime kiln flue gas, coal chemical tail gas or petrochemical tail gas. The content of carbon dioxide is between 15%-98%.

Furthermore, in this embodiment, the carbonate products produced from the $CO_2$ mineralization process based on industrial solid waste can be partially recycled to the slag forming treatment process, as slag forming agents or a supplement to the slag forming agent that needs to be added, such as limestone. In this way, another internal circulation system is constructed. Compared with the prior art, the circulation process is advantageous in that the calcium and magnesium elements in the existing industrial solid waste can be fully utilized, and the resources can be well reused. The internal circulation process can also ensure the continuity of the reaction process and improve the reaction efficiency.

The above method for obtaining sponge iron based on the reforming slag also includes a step of inputting syngas or CO or $H_2$ or a mixture of CO and $H_2$. In the direct reduction iron process, the as-mentioned gas reacts with the reforming slag to obtain high-purity sponge iron.

In order to treat the $SiO_2$ and sulfur-bearing substances during the iron making and slag making process, slag forming treatment is generally carried out by applying slag forming agents (such as limestone or carbonate product in this embodiment). The as-mentioned substances react with limestone to form calcium silicate, calcium sulfide, etc. (The reforming slag described below includes but is not limited to calcium silicate, calcium sulfide, etc.) The above substances and carbonate products react to generate calcium silicate, magnesium silicate or calcium magnesium silicate. When sulfur is present, the reaction products also include calcium sulfide, magnesium sulfide or calcium magnesium sulfide. Therefore, before the reforming slag is coupled with the $CO_2$ mineralization process based on industrial solid waste, a desulfurization treatment of the reforming slag is included to reduce the impact of sulfur on the $CO_2$ mineralization process based on industrial solid waste. Notably, the above desulfurization treatment is not necessary if the reforming slag does not contain sulfur or the content of sulfur is very low. The configuration of desulfurization treatment depends on the specific composition of raw materials.

Furthermore, in this embodiment, the above $CO_2$ mineralization process based on industrial solid waste includes the following steps:

- a mixing reaction process, where the industrial solid waste, auxiliary reagent and $CO_2$ are reacted in the mixing reaction device;
- a solid-liquid separation treatment, where the slurry generated by the above mixing reaction is subjected to a solid-liquid separation.
- a process where the supernatant and unreacted solid particles are obtained.

In this embodiment, the industrial solid waste includes but is not limited to steel slag, raw ore materials or tailings, other industrial wastes, etc. The raw ore materials include calcium magnesium ores. Other industrial wastes include iron slag, fly ash, bottom ash, red mud, construction waste/waste cement, tailings, etc.

A carbonate product is prepared based on the obtained supernatant, wherein the carbonate product includes calcium carbonate, magnesium carbonate or calcium magnesium carbonate. The carbonate products can partially participate in the slag forming treatment, as slag forming agents or as a supplement to slag forming agents (such as limestone) that need to be added, resulting in another internal circulation system.

Furthermore, the unreacted solid particles are recycled to the mixing reaction process, to fully extract and reuse the effective components in the unreacted solid particles.

In this embodiment, the auxiliary reagent comprises at least one organic acid, or one salt based on an organic acid radical or a combination of both. The organic acid includes but is not limited to oxalic acid, citric acid, picolinic acid, gluconic acid, glutamic acid, formic acid, acetic acid, propionic acid, butyric acid, valeric acid, lactic acid, succinic acid, phosphoric acid, pyrophosphoric acid, ascorbic acid, or phthalic acid. In this embodiment, by adjusting the pressure of carbon dioxide, the proportion of auxiliary reagents and the reaction temperature, the use of strong acid or highly corrosive acid (such as nitric acid, hydrochloric acid, sulfuric acid, and hydrofluoric acid) is avoided, and a continuous leaching of the target component is realized.

Figure 2:
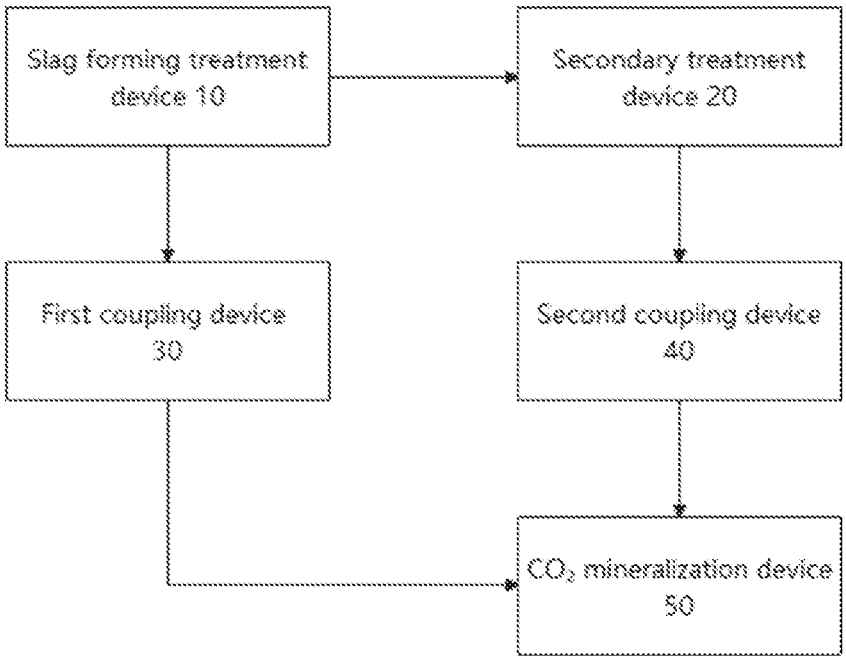
FIG. 2: block diagram of the coupling system of copper slag recycling and $CO_2$ mineralization process based on industrial solid waste in an embodiment of the invention.

As shown in FIG. 2, this embodiment also proposes a coupling system of copper slag recycling and $CO_2$ mineralization process based on industrial solid waste, including:

- a slag forming treatment device 10, which is used to obtain reforming slag from the copper slag;
- a secondary treatment device 20, which is employed for secondary treatment of the reforming slag to obtain sponge iron;
- a first coupling device 30, which is designed to convey the obtained reforming slag to the $CO_2$ mineralization device 50 based on industrial solid waste;
- a second coupling device 40, which is configured to transport the $CO_2$ generated by the secondary treatment device 20 to the $CO_2$ mineralization device 50 based on industrial solid waste.

The technical features of this coupling system have been described above and will not be repeated here.

In this embodiment, a dual internal circulation can be achieved through the first coupling device 30 and the second coupling device 40, and the recycling of copper slag can be coupled with the existing $CO_2$ mineralization process based on industrial solid waste. Various production lines can be organically integrated for both reforming slag and flue gas, leading to a green and clean production.

The first coupling device 30 also transports the $CO_2$ generated by the slag forming treatment device 10 to the $CO_2$ mineralization device based on industrial solid waste.

Figure 3:
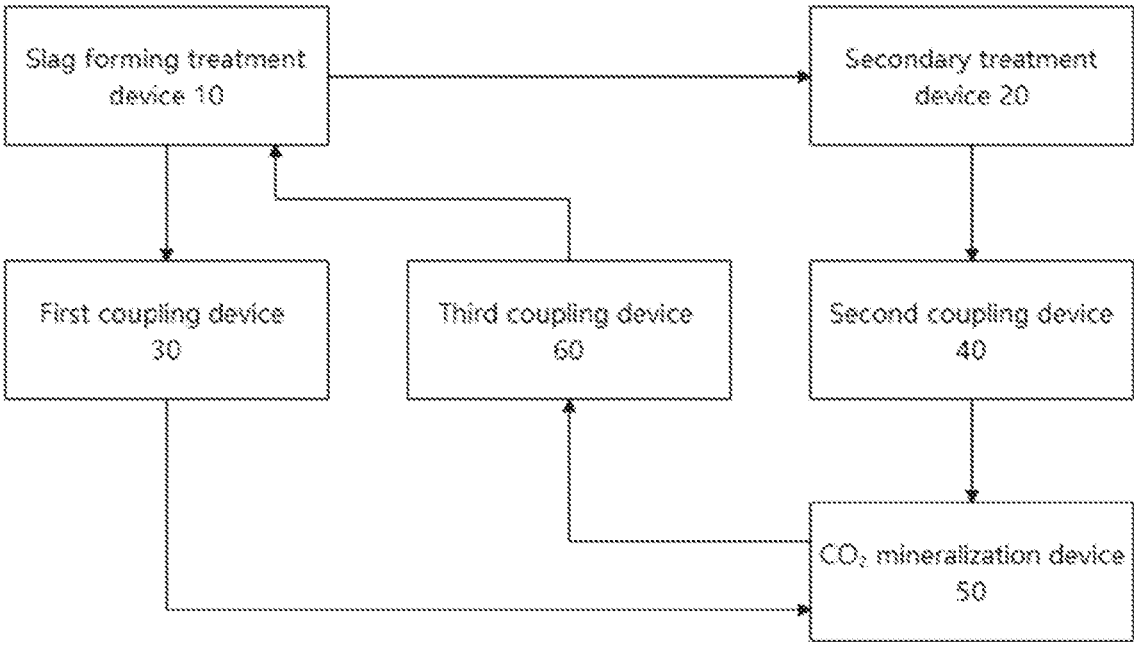
FIG. 3: block diagram of the coupling system of copper slag recycling and $CO_2$ mineralization process based on industrial solid waste in another embodiment of the invention.

As shown in FIG. 3, the system also includes a third coupling device 60, which is used to transport part of the carbonate products generated by the $CO_2$ mineralization device 50 based on industrial solid waste to the slag forming treatment device 10. Based on the first coupling device 30 and the second coupling device 40, the third coupling device 60 is additionally configured to realize a triple internal circulation system. The third coupling device 60 can recycle part of the carbonate products prepared by the $CO_2$ mineralization process based on industrial solid waste to the slag forming treatment process, as slag forming agents or a supplement to the slag forming agents that need to be added. This circulation process is advantageous in that the calcium and magnesium elements in the existing industrial solid waste can be fully utilized, and the resources can be well reused. The internal circulation process can also ensure the continuity of the reaction process and improve the reaction efficiency.

This embodiment also includes a desulfurization device, which is used to desulfurize the reforming slag before it moves into to the $CO_2$ mineralization device 50 based on industrial solid waste. Notably, the desulfurization treatment is not necessary if the reforming slag does not contain sulfur or the content of sulfur is very low. The configuration of desulfurization treatment depends on the specific composition of raw materials.

Figure 4:
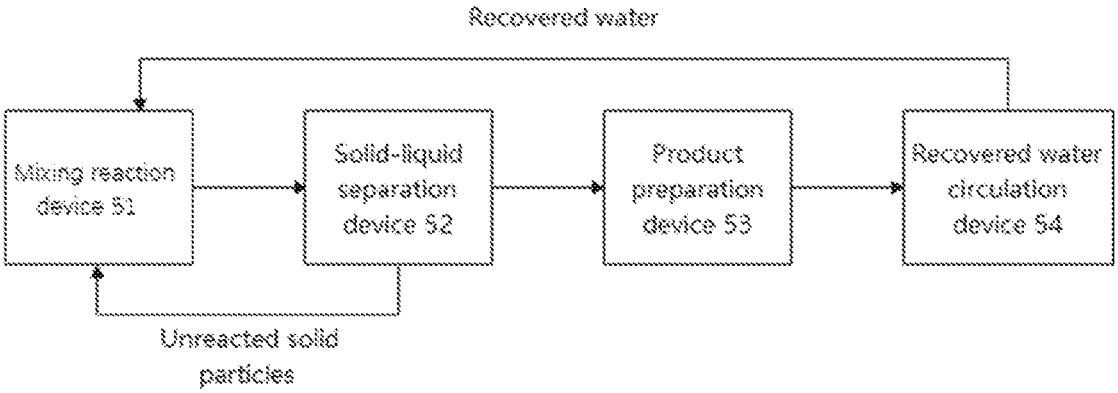
FIG. 4: block diagram of $CO_2$ mineralization device based on industrial solid waste in an embodiment of the invention.

In this embodiment, as shown in FIG. 4, the $CO_2$ mineralization device 50 based on industrial solid waste includes:

- a mixing reaction device 51, where the industrial solid waste, auxiliary reagent and $CO_2$ are reacted in the mixing reaction device 51;
- a solid-liquid separation device 52, where the slurry generated by the above mixing reaction is subjected to a solid-liquid separation.

Through the above mixing reaction, solid-liquid separation and other processes, the target carbonate products can be obtained, such as calcium carbonate, magnesium carbonate or calcium magnesium carbonate.

This embodiment also includes a product preparation device 53 for producing carbonate products based on the clear liquid phase after the solid-liquid separation device 52. The clear liquid contains target ions, such as calcium ions, magnesium ions or a mixture of both. The target product is calcium magnesium carbonate, calcium carbonate or magnesium carbonate.

The embodiment also includes a recovered water circulation device 54. After the clear liquid phase generates the products, the recovered water is circulated to the mixing reaction device 51 through the recovered water circulation device 54, and the recovered water will be circulated at least two times (m≥2).

Furthermore, the mixing reaction device 51 is also continuously fed with steel slag, auxiliary reagent and water at a certain proportion, and the slurry is obtained after well mixing. Carbon dioxide is continuously injected into the mixing reaction device 51 under a certain pressure and reacts with the slurry. The reacted slurry is continuously discharged out of the mixing reaction device 51. The steel slag can also be replaced with other industrial wastes, such as iron slag, fly ash, bottom ash, red mud, construction waste/waste cement, tailings, etc. The steel slag can also be replaced with raw ore materials or tailings, and the raw ore materials include calcium magnesium ores.

The specific classification of the auxiliary reagent is described above. In this embodiment, by adjusting the pressure of carbon dioxide, the proportion of auxiliary reagents and the reaction temperature, the use of strong acid or highly corrosive acid (such as nitric acid, hydrochloric acid, sulfuric acid, and hydrofluoric acid) is avoided, and a continuous leaching of the target component is realized.

The slurry out of the mixing reaction device 51 is subjected to at least one stage of solid-liquid separation treatment through the solid-liquid separation device 52, and the unreacted solid particles obtained from the solid-liquid separation will be recycled as raw materials for the next stage of reaction and separation.

The solid-liquid separation device 52 preferably adopts a two-stage solid-liquid separation configuration. Specifically, the solid-liquid separation device 52 includes a primary coarse separation unit and a secondary fine separation unit. The primary coarse separation unit is used to remove particle of sizes≥5-10 μm in diameter. The secondary fine separation unit is used to remove solid particles with a particle size≤1-5 μm in diameter. Through the multi-stage separation, the optimized separation scheme for particles of different sizes ensures that the solid-liquid separation can be carried out stably and continuously under the optimal load conditions. Such configuration effectively shortens the overall separation time, prolongs the stable operation of the separation system, and effectively avoids the technical problems caused by a single-stage separation.

Further preferably, the solid-liquid separation device 52 is also provided with a three-stage solid-liquid separation unit based on the two-stage solid-liquid separation. In this setup, the clear liquid phase containing target ions can be obtained by a disc centrifuge, a plate and frame filter press or a filter. The clear liquid containing the target ions is transported to the product preparation device 53.

When the clear liquid phase contains a high concentration of iron elements, the iron hydroxide precipitation is collected through enrichment and in this way, the irons can be reasonably and effectively recovered and utilized.

The above embodiments are only used to illustrate the technical scheme of the invention with reference to the preferred embodiments, but the invention is not limited by these embodiments. It should be understood by technicians in this field that the embodiments of the present invention can be modified or equivalently replaced without departing from the spirit and scope of this invention which shall be all included in the claims of the invention.

What is claimed is:

1. A coupling method of copper slag recycling and $CO_2$ mineralization process based on industrial solid waste, comprising the following steps:

obtaining copper slags;

performing a slag forming treatment based on the copper slags;

obtaining reforming slags based on the slag forming treatment;

obtaining sponge iron based on the reforming slag;

coupling the reforming slag with a $CO_2$ mineralization process based on industrial solid waste; and coupling $CO_2$ generated in a process of obtaining the sponge iron with the $CO_2$ mineralization process based on the industrial solid waste, wherein the $CO_2$ mineralization process comprises subjecting a slurry produced in the $CO_2$ mineralization process to a multi-stage solid-liquid separation including a primary coarse separation that removes particles of 5-10 μm and a secondary fine separation that removes particles of 1-5 μm.

2. The coupling method according to claim 1, wherein $CO_2$ produced in the slag forming treatment is coupled with the $CO_2$ mineralization process based on the industrial solid waste.

3. The coupling method according to claim 2, wherein the $CO_2$ mineralization process based on the industrial solid waste further comprises the following steps:

performing a mixing reaction process based on the industrial solid waste, auxiliary reagent, and $CO_2$ to obtain the slurry;

performing the multi-stage solid-liquid separation treatment based on the slurry produced in the mixing reaction process; and obtaining a supernatant and unreacted solid particles.

4. The coupling method according to claim 1, wherein at least a portion of a carbonate product obtained from the $CO_2$ mineralization process based on the industrial solid waste is recycled to and participates in the slag forming treatment.

5. The coupling method according to claim 4, wherein the $CO_2$ mineralization process based on the industrial solid waste further comprises the following steps:

performing a mixing reaction process based on the industrial solid waste, auxiliary reagent, and $CO_2$ to obtain the slurry;

performing the multi-stage solid-liquid separation treatment based on the slurry produced in the mixing reaction process; and obtaining a supernatant and unreacted solid particles.

6. The coupling method according to claim 1, wherein, in the process of obtaining the sponge iron based on the reforming slag also comprises a step of inputting at least one gas selected from the group consisting of syngas, CO, and $H_2$.

7. The coupling method according to claim 6, wherein the $CO_2$ mineralization process based on the industrial solid waste further comprises the following steps:

performing a mixing reaction process based on the industrial solid waste, auxiliary reagent, and $CO_2$ to obtain the slurry;

performing the multi-stage solid-liquid separation treatment based on the slurry produced in the mixing reaction process; and obtaining a supernatant and unreacted solid particles.

8. The coupling method according to claim 1, wherein before coupling the reforming slag with the $CO_2$ mineralization process based on the industrial solid waste, a desulfurization treatment is applied to the reforming slag.

9. The coupling method according to claim 8, wherein the $CO_2$ mineralization process based on the industrial solid waste further comprises the following steps:

performing a mixing reaction process based on the industrial solid waste, auxiliary reagent, and $CO_2$ to obtain the slurry;

performing the multi-stage solid-liquid separation treatment based on the slurry produced in the mixing reaction process; and obtaining a supernatant and unreacted solid particles.

10. The coupling method according to claim 1, wherein the $CO_2$ mineralization process based on the industrial solid waste further comprises the following steps:

performing a mixing reaction process based on industrial solid waste, auxiliary reagent, and $CO_2$ to obtain the slurry;

performing the multi-stage solid-liquid separation treatment based on the slurry produced in the mixing reaction process; and obtaining a supernatant and unreacted solid particles.

11. The coupling method according to claim 10, the $CO_2$ mineralization process based on the industrial solid waste further comprises a carbonate product prepared based on the supernatant; and/or, recycling the unreacted solid particles to the mixing reaction process.

12. The coupling method according to claim 11, wherein the carbonate product comprises calcium carbonate, magnesium carbonate or calcium magnesium carbonate.

* * * * *